US009765595B2

(12) United States Patent
Themig et al.

(10) Patent No.: US 9,765,595 B2
(45) Date of Patent: Sep. 19, 2017

(54) WELLBORE ACTUATORS, TREATMENT STRINGS AND METHODS

(71) Applicant: PACKERS PLUS ENERGY SERVICES INC., Calgary (CA)

(72) Inventors: Daniel Jon Themig, Calgary (CA); Robert Joe Coon, Missouri City, TX (US)

(73) Assignee: Packers Plus Energy Services Inc., Calgary (CA)

( * ) Notice: Subject to any disclaimer, the term of this patent is extended or adjusted under 35 U.S.C. 154(b) by 476 days.

(21) Appl. No.: 14/350,918

(22) PCT Filed: Oct. 9, 2012

(86) PCT No.: PCT/CA2012/050711

§ 371 (c)(1),
(2) Date: Apr. 10, 2014

(87) PCT Pub. No.: WO2013/053057

PCT Pub. Date: Apr. 18, 2013

(65) Prior Publication Data

US 2014/0246209 A1 Sep. 4, 2014

Related U.S. Application Data

(60) Provisional application No. 61/545,818, filed on Oct. 11, 2011.

(51) Int. Cl.
*E21B 34/14* (2006.01)
*E21B 43/14* (2006.01)
(Continued)

(52) U.S. Cl.
CPC ..... *E21B 34/14* (2013.01); *E21B 33/12* (2013.01); *E21B 34/063* (2013.01); *E21B 43/12* (2013.01);
(Continued)

(58) Field of Classification Search
CPC ..... E21B 34/14; E21B 34/063; E21B 33/12; E21B 43/14; E21B 43/12; E21B 2034/007
See application file for complete search history.

(56) References Cited

U.S. PATENT DOCUMENTS 3,878,889 A 4/1975 Seabourn
4,292,988 A * 10/1981 Montgomery ..... E21B 21/10 137/68.17
(Continued)

FOREIGN PATENT DOCUMENTS

CN 201915931 8/2011
CN 103982167 8/2014
(Continued)

OTHER PUBLICATIONS

European Search Report for EP 12840384.7, Oct. 9, 2015, Munich.
(Continued)

*Primary Examiner* — Blake Michener
(74) *Attorney, Agent, or Firm* — Roseann Caldwell; Matthew Vella; Pia Diaconescu

(57) ABSTRACT

A wellbore tubing string assembly comprises: a string including an inner bore having an inner diameter and a plurality of tools installed along the string including a first tool and a second tool axially offset from the first tool along the string; the first tool includes: a first sleeve in the inner bore having an inner surface, the inner surface defining a first restriction diameter smaller than the inner diameter; a first sensor mechanism in communication with the first sleeve and responsive to an application of force against the first sleeve; the second tool includes; a second sleeve in the inner bore having an inner wall surface, the inner wall surface defining a second restriction diameter smaller than the inner diameter; a second sensor mechanism in communication with the second sleeve and responsive to an appli-
(Continued)

cation of force against the second sleeve; and a sealing device having a diameter greater than the second restriction diameter and being deformable to be pushable through the second restriction diameter to apply a force against the second sleeve.

6 Claims, 8 Drawing Sheets

(51) Int. Cl.
*E21B 34/06* (2006.01)
*E21B 43/12* (2006.01)
*E21B 33/12* (2006.01)
*E21B 34/00* (2006.01)

(52) U.S. Cl.
CPC ..... *E21B 43/14* (2013.01); *E21B 2034/007* (2013.01)

(56) References Cited

U.S. PATENT DOCUMENTS 4,729,432 A * 3/1988 Helms ..... E21B 21/10 166/317
4,823,882 A * 4/1989 Stokley ..... E21B 33/127 166/120
4,889,199 A 12/1989 Lee
4,893,678 A 1/1990 Stokley et al.
5,146,992 A * 9/1992 Baugh ..... E21B 34/14 166/154
5,244,044 A * 9/1993 Henderson ..... E21B 23/04 166/238
5,499,687 A 3/1996 Lee
5,797,454 A 8/1998 Hipp
5,901,796 A 5/1999 McDonald
6,923,255 B2 8/2005 Lee
6,948,561 B2 9/2005 Myron
6,966,368 B2 11/2005 Farquhar
7,055,605 B2 6/2006 Howlett et al.
7,146,029 B2 12/2006 Manansala
7,373,974 B2 * 5/2008 Connell ..... E21B 17/06 166/242.1
7,469,744 B2 12/2008 Ruddock et al.
7,699,100 B2 4/2010 Robichaux et al.
8,261,761 B2 9/2012 Gerrard et al.
8,479,808 B2 7/2013 Gouthaman
8,479,823 B2 7/2013 Mireles
8,668,013 B2 3/2014 O'Connell et al.
8,783,365 B2 7/2014 McCoy et al.
8,863,853 B1 10/2014 Harris et al.
8,950,496 B2 2/2015 Kitzman
9,004,179 B2 4/2015 Chauffe
9,010,447 B2 4/2015 Themig et al.
9,121,273 B2 9/2015 Norrid
9,187,978 B2 11/2015 Castro
9,290,998 B2 3/2016 Radford
2003/0127227 A1 * 7/2003 Fehr ..... E21B 33/124 166/306
2005/0178552 A1 * 8/2005 Fehr ..... E21B 33/124 166/305.1
2006/0124310 A1 * 6/2006 Lopez de Cardenas ..... E21B 34/06 166/313
2006/0124312 A1 * 6/2006 Rytlewski ..... E21B 23/02 166/313
2006/0243455 A1 11/2006 Telfer et al.
2007/0044958 A1 * 3/2007 Rytlewski ..... C09K 8/68 166/250.01
2007/0151734 A1 * 7/2007 Fehr ..... E21B 33/124 166/305.1
2008/0093080 A1 4/2008 Palmer et al.
2009/0056952 A1 3/2009 Churchill
2009/0084553 A1 * 4/2009 Rytlewski ..... E21B 34/06 166/305.1
2009/0308588 A1 12/2009 Howell et al.
2010/0089583 A1 4/2010 Xu et al.
2010/0252276 A1 10/2010 Clausen et al.
2010/0282469 A1 * 11/2010 Richard ..... E21B 33/1208 166/308.1
2010/0294510 A1 * 11/2010 Holmes ..... E21B 41/00 166/376
2010/0294514 A1 11/2010 Crow et al.
2011/0114334 A1 5/2011 Palacios
2011/0120773 A1 5/2011 Hilliard
2011/0127047 A1 * 6/2011 Themig ..... E21B 34/063 166/386
2011/0203799 A1 * 8/2011 Hofman ..... E21B 43/00 166/308.1
2011/0232915 A1 9/2011 Kellner et al.
2012/0024109 A1 2/2012 Xu et al.
2012/0085548 A1 * 4/2012 Fleckenstein ..... E21B 34/063 166/373
2012/0118573 A1 * 5/2012 Richard ..... E21B 33/1208 166/308.1
2012/0205120 A1 * 8/2012 Howell ..... E21B 34/108 166/373
2012/0227973 A1 9/2012 Hart et al.
2013/0014953 A1 * 1/2013 van Petegem ..... E21B 34/14 166/308.2
2013/0068474 A1 * 3/2013 Hofman ..... E21B 34/08 166/373
2013/0081827 A1 * 4/2013 Etzel ..... E21B 34/14 166/386
2013/0133876 A1 * 5/2013 Naedler ..... E21B 43/16 166/101
2013/0175033 A1 * 7/2013 Baihly ..... E21B 34/14 166/284
2013/0180721 A1 7/2013 Getzlaf et al.
2013/0233535 A1 * 9/2013 Pacey ..... E21B 34/14 166/206
2013/0233564 A1 * 9/2013 Pacey ..... E21B 34/14 166/373
2013/0299199 A1 * 11/2013 Naedler ..... E21B 43/14 166/386
2014/0008071 A1 1/2014 Patterson et al.
2014/0041876 A1 * 2/2014 Fleckenstein ..... E21B 34/08 166/306
2014/0076542 A1 3/2014 Whitsitt et al.
2014/0138101 A1 5/2014 Arabsky et al.
2014/0151054 A1 * 6/2014 Norrid ..... E21B 34/14 166/318
2014/0166304 A1 6/2014 Cast et al.
2014/0246209 A1 9/2014 Themig et al.
2014/0291031 A1 10/2014 Lee et al.
2014/0299319 A1 10/2014 Pabon et al.
2015/0114664 A1 4/2015 Hulsewe et al.

FOREIGN PATENT DOCUMENTS

WO 0190529 11/2001
WO 02068793 9/2002
WO 2011072367 6/2011
WO 2016019154 2/2016
WO 2016049751 4/2016
WO 2016049771 4/2016

OTHER PUBLICATIONS

Steve Chauffe; Nigel Pence; Michael Harris, Tools Team Oil, Frac Sleeve Designed for Multi-Zone Cemented Laterals, SPE-174075-MS, Apr. 27, 2015, pp. 1-13, Society of Petroleum Engineers, Garden Grove, California.
Feng Yuan, Eric Blanton, Jamie Inglesfield, Weatherford, Single-Size-Ball Interventionless Multi-Stage Stimulation Improves Stimulated Reservoir Volume and Eliminates Milling Requirements: Case Studies, SPE-171183-M, Oct. 14, 2014, pp. 1-13, Society of Petroleum Engineers, Moscow, Russia.
Baker Hughes Incorporated, Optimize Well Completions with Increased Number of Ball-Activated Stages, FracPoint EX-C Frac Sleeve System, 2011.

(56) References Cited

OTHER PUBLICATIONS

Schlumberger Limited, nZone Multistage Fracturing System for Cemented Applications, http://www.slb.com/services/completions/multistage_stimulation_systems/continuous_pumping_stimulation/nzone_cemented_multistage_stimulation_system.aspx, 2013.

* cited by examiner 165
166
162
160
164
122
150
117
110
124a
P
124b
150'

WELLBORE ACTUATORS, TREATMENT STRINGS AND METHODS

BENEFIT OF EARLIER APPLICATION

This application claims priority from U.S. Ser. No. 61/545,818, filed Oct. 11, 2011.

FIELD

The invention relates to wellbore apparatus and methods and in particular, apparatus for actuation of wellbore tools and wellbore treatment apparatus and methods.

BACKGROUND

Many wellbore systems require downhole actuation of tools. Sliding sleeves are employed in apparatus for actuation of wellbore tools, wherein a plug structure, often called a ball, is launched to land in the sleeve and pressure can be employed to move the sleeve. Movement of the sleeve may open ports in the downhole tool, communicate tubing pressure to a hydraulically actuated mechanism, or effect a cycle in an indexing mechanism such as a counter. A sliding sleeve based wellbore actuator may be employed alone in a wellbore string or in groups. For example, some wellbore treatment strings, for example, those for introducing fluid along a length of a well, may include a number of sliding sleeve based wellbore actuators spaced apart. One wellbore treatment, know as wellbore stimulation, for example fracturing, employs a string with a plurality of sliding sleeve based wellbore actuators spaced therealong. The sliding sleeves are moveable to open ports through which wellbore treatment fluid can be introduced from the wellbore string to the wellbore to treat the formation. The sleeves can be opened in groups or one at a time, depending on the desired treatment to be effected.

Many sliding sleeve based actuators employ constrictions on the sleeve to catch the plug. The constriction protrudes into the inner diameter of the string and catches the plug when it attempts to pass. The constriction, or a sealing area adjacent thereto, creates a seal with the plug and forms a piston-like structure that permits a pressure differential to be developed relative to the ends of the sleeve and the sleeve is driven to the lower pressure side. The constriction on the sleeve may be a frustoconically tapering seat, dogs, collets, rings, etc. While some plugs actuate one sliding sleeve only, it is desirable sometimes to have a plug that actuates a plurality of sleeves as it moves through a string. Thus, some constrictions have been developed that are able to be overcome: to catch a plug, be actuated by the plug and then release it. Such constrictions may be deformable or convertible and therefore repeat-acting and the sleeves with which they are associated may be intended to be actuated more than once and/or may convert downhole.

While these sleeve based actuators have proven to be effective, some actuators have set diameters across their constrictions that limit the number of sleeves that can be employed in the well. On the other hand, while the deformable or convertible repeating ID constriction mechanisms allow greater numbers of sleeves, they can have complicated and sensitive mechanisms that can adversely impact cost and reliability.

SUMMARY OF THE INVENTION

In accordance with a broad aspect of the present invention, there is provided a wellbore tubing string assembly comprising: a string including an inner bore having an inner diameter and a plurality of tools installed along the string including a first tool and a second tool axially offset from the first tool along the string; the first tool including: a first sleeve in the inner bore having an inner surface, the inner surface defining a first restriction diameter smaller than the inner diameter; a first sensor mechanism in communication with the first sleeve and responsive to an application of force against the first sleeve; the second tool including; a second sleeve in the inner bore having an inner wall surface, the inner wall surface defining a second restriction diameter smaller than the inner diameter; a second sensor mechanism in communication with the second sleeve and responsive to an application of force against the second sleeve; and a sealing device having a diameter greater than the second restriction diameter and being deformable to be pushable through the second restriction diameter to apply a force against the second sleeve.

In accordance with another broad aspect of the present invention, there is provided a wellbore tubing string assembly comprising: a string including an inner bore having an inner diameter and a distal end; a first tool installed in the string and including: a first sleeve in the inner bore having an inner surface, the inner surface defining a first restriction diameter smaller than the inner diameter; a first sensor mechanism in communication with the first sleeve and responsive to an application of force against the first sleeve; a sealing device having a diameter greater than the first restriction diameter and being deformable to be pushable through the first restriction diameter to apply a force against the first sleeve; and a second tool axially offset from the first tool along the string, the second tool being positioned closer to the distal end than the first tool and including a ball stop protruding into the inner bore, the ball stop having a diameter less than the first restriction diameter and formed to stop and create a seal in the inner bore with a plug conveyed through the string such that fluid is stopped from flowing past the plug in the ball stop.

In accordance with another broad aspect of the present invention, there is provided a method for actuating a tool in a wellbore string, comprising: placing the wellbore string in a wellbore, the string including an upper tool and a lower tool axially offset from the upper tool, the upper tool being actuatable by application of an axially directed force thereto, launching a sealing device to move through the string and arrive at the tool, applying pressure to deform the sealing device and to push the sealing device through an inner bore of the upper tool, which applies a force against the tool sufficient to actuate the tool; and landing the sealing device on the second tool.

In accordance with another broad aspect of the present invention, there is provided a wellbore actuator comprising: a tubular body having an inner bore defining an inner diameter; a sleeve valve in the inner bore having an inner surface with at least a portion protruding into the inner bore, the portion being formed of a material degradable by contact with a reactive fluid in the wellbore during a residence time; and a sealing device sized to bear against and apply a force to the sleeve valve when sealing device passes into the inner bore.

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all within the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS

Figure 1A:
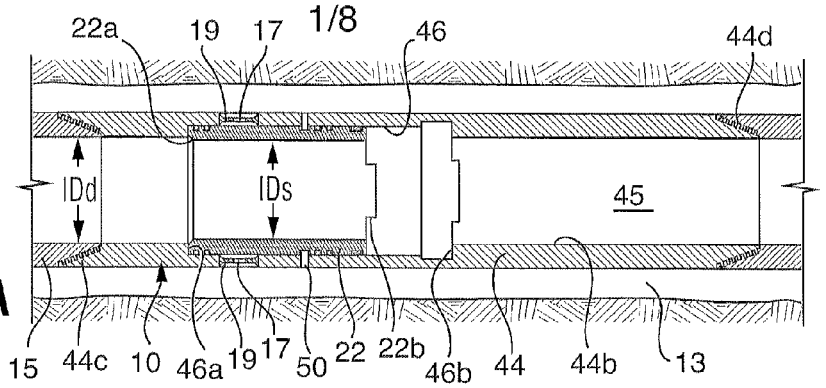
FIGS. 1A to 1D are a series of sectional views through a wellbore actuator according to an aspect of the present invention.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

This invention relates to a wellbore actuator, a wellbore treatment string and a method for wellbore operations.

In this invention, an actuator includes a mechanism through which the actuator is actuated including a substantially fixed inner diameter (ID) restriction and a sensor mechanism to sense force applied to the ID restriction through which the actuator tool is actuated, and a deformable sealing device that can pass through the ID restriction and create a reliable force against the ID restriction which is communicated to the sensor mechanism. The sealing device is selected to have an outer diameter greater than the inner diameter through the ID restriction (i.e. the sealing device is selected to have an interference fit with the ID restriction), but can be forced by fluid pressure to pass through the restriction and in so doing creates a reliable force on the tool. In particular, the passage of the ball through the restriction creates a force that is reliable, for example, of a known minimum value, such that the mechanism can be set to be actuated by that force.

The actuator may be useful for controlling the closed/open condition of ports in a wellbore tool or control the operation of another tool such as the setting of a packer, etc.

The ID restriction may be any structure in the tool's bore that is narrower than the tool's normal inner diameter (drift diameter) and that can receive the force applied by passage of the sealing device. For example, the ID restriction may be at least a portion of a sliding sleeve, which is sometimes alternately called a mandrel, an insert or a sub. In one embodiment, for example, the ID restriction is formed as a structure (i.e. a narrowing, a neck, a shoulder, a protrusion) that creates a restriction in the inner diameter of a sliding sleeve valve. The sliding sleeve valve is generally axially moveable in response to the application of force and covers ports or controls hydraulic access to a tubing string tool. The ID restriction may be along the full length of the sleeve or may be positioned along only a portion of the sleeve. Hereinafter, the term "ID restriction" sometimes refers to the sleeve in its entirety and sometimes refers to just the smaller diameter restriction in the sleeve.

The sensor may include a strain gauge or a releasable lock or a biasing member. For example, the sensor may be a releasable lock such as a snap ring, shear pins, collet catch, detents, etc., that are selected to be overcome by a particular force applied thereto. Alternately or in addition, the sensor may be a biasing member, for example a biasing member of an indexing mechanism.

The sealing device may be a fluid conveyable plug, such as a ball, dart, etc. It can be free from connection to surface to facilitate operations.

The force can move the actuator through a mechanical shift. The shift can be a single cycle shift, directly into a final position or the shift can be indexed for example to take the tool through one or more inactive (also called passive) positions before it moves into an active condition.

With reference to FIGS. 1A to 1D, a wellbore actuator 10 is shown in a position in a well defined by wall 12. When in the well, a space, defined as the annulus 13, is formed between the actuator and the wall.

The actuator is formed as a tubing string sub that can be secured into a wellbore string 15. The sub includes a tubular wall 44 having an outer surface 44*a* and an inner wall surface 44*b* that defines an inner bore 45 of the sub. One or more ports 17 are positioned in wall 44 and, when open, provide for fluid communication between inner bore 45 and outer surface 44*a*. The sub includes ends 44*c*, 44*d* for connection into a tubing string. The ends may, for example, be threaded for normal connection to other subs forming the string.

Figure 1B:
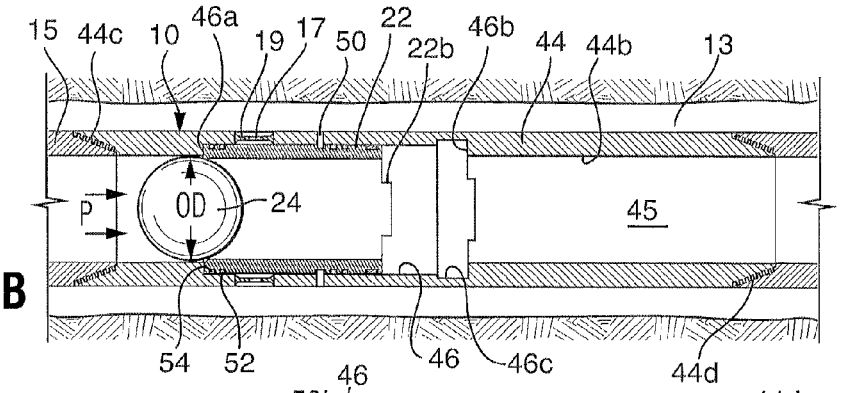
Figure 1C:
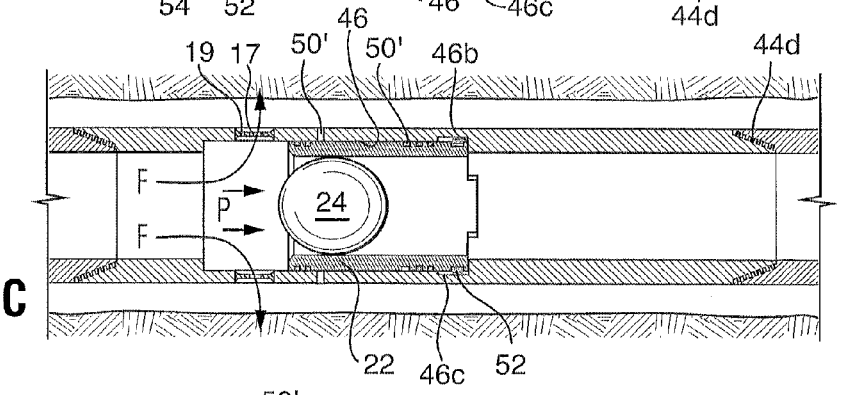
Figure 1D:
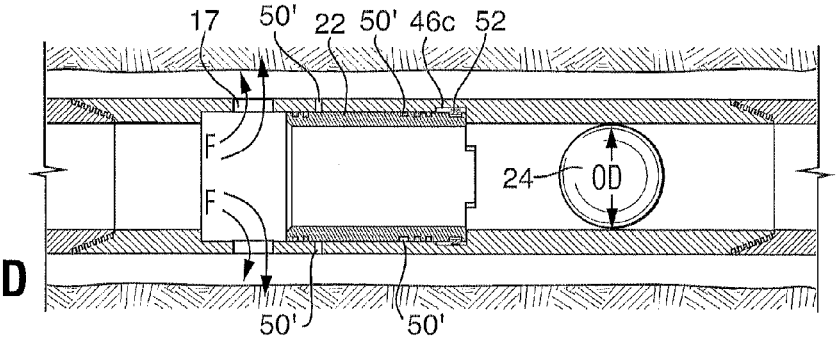

The sub includes a sleeve 22, positionable over a plurality of ports 17 to close them against fluid flow therethrough. Sleeve 22 is moveable from a position (called the closed port position), as shown in FIGS. 1A and 1B, wherein the ports are covered by the sleeve and to a position (called the port exposed position), as shown in FIGS. 1C and 1D, wherein ports 17 are exposed to bore 45 and fluid from the inner bore can contact the ports. After the ports are exposed, the ports may be plugged or already open to some degree. As shown, ports include inserts 19 that restrict flow therethrough but allow a small opening through which an erosive flow can pass. If/when ports 17 are open, fluid can flow, arrows F, therethrough.

Wall 44 may have formed on its inner surface a cylindrical groove 46 for retaining sleeve 22. Shoulders 46*a*, 46*b* define the ends of the groove 46 and limit the range of movement of the sleeve. Shoulders 46*a*, 46*b* can be formed in any way as by casting, milling, etc. the wall material of the sub or by threading parts together, as at connection 48.

In the closed port position, sleeve 22 is positioned adjacent shoulder 46*a* and over ports 17. The length of the sleeve is selected with consideration as to the distance between shoulder 46*b* and ports 17 to permit the ports to be exposed, to some degree, when the sleeve is driven against shoulder 46*b*. Sleeve 22 may have a lock that secures the sleeve in the open position. In this embodiment, lock 52 is a snap ring that expands out into groove 46*c*. To facilitate drill out, the actuator may include a sleeve anti-rotation mechanism such as a torque pin/slot or a castellated end 22*b*.

It may be desirable for the tubing string to hold pressure, when the ports are closed. For example, the tubing string is resistant to fluid flow outwardly therefrom except through open ports. Thus, seals 52 may be provided between sleeve and wall 44 to resist fluid communication to the ports until the sleeve is moved to expose the ports. Seals 52 here are illustrated as o-rings disposed in glands 54 on the outer surface of the sleeve, so that fluid bypass between the sleeve and wall 44 is substantially prevented. In addition, any connection, such as connection 48, in the sub may be selected to be substantially pressure tight.

Shear pins 50 are secured between wall 44 and sleeve 22 to hold the sleeve in this position. A ball 24, also called a plug, is used to create a force through sleeve 22 to shear pins, shown sheared as 50', and to move the sleeve to the port-exposed position. When the ball arrives at the sleeve, it is stopped on the ID restriction presented by the sleeve. The ball blocks fluid flow past the sleeve and pressure builds up uphole of the ball. Eventually, the pressure differential across the ball develops a significant force. As a result of the pressure P acting against ball 24, it squeezes through the sleeve. The ball can deform as it passes through the sleeve (FIG. 10). As ball 24 blocks flow through the sleeve and squeezes through the sleeve, it creates a force on the sleeve. This force is used to manipulate the actuator and, in this embodiment, to shift sleeve 22 to the port-exposed position.

Ball 24 is deformable. The ball may be plastically deformable or elastically deformable. In one embodiment, the ball is substantially resilient, such that after it deforms to pass through sleeve 22, the ball recovers to some degree for example toward its original diameter (FIG. 1D). The deformable properties of the ball, enable the ball to be useful to manipulate one actuator, or even a plurality of actuators, as it passes through the string. A ball that cannot deform to pass through a sleeve with some interference (i.e. a ball that fails or a ball that stops and won't pass through), should be avoided.

The ball is deformable and has an outer diameter OD that is less than the drift (i.e. normal) diameter IDd of the string, such that the ball can readily pass through the string by gravity, pumping or rolling. Sleeve 22 has a restriction diameter IDs that is smaller than the IDd of the string and is smaller than the outer diameter OD of ball 24 intended for use with the sleeve. Thus, ball 24 can only pass through the sleeve's inner diameter if sufficient force is applied to deform it and push it through. The force is applied by fluid pressure, arrows P. When the ball arrives at sleeve 22, it first seats on the uphole end 22*a* of the sleeve and, thereafter, the pressure builds uphole of the ball to deform it and push the ball through the sleeve. As the ball pushes through the sleeve, it creates a piston effect and the force applied to the ball to deform it and push it through sleeve is transferred to the sleeve. The force applied is selected to be sufficient to shear pins 50 and sleeve 22 is released allowing it to be driven against shoulder 46*b*. The upper end 22*a* of the sleeve may be chamfered to facilitate the ball's entry to the sleeve inner diameter.

When sleeve is stopped against shoulder 46*b*, the pressure then forces ball 24 fully through the restricted diameter of the sleeve. After the ball passes out of sleeve 22, it can continue to be moved along and, if desired, can act against another tool downhole of that sleeve 22.

If the ball has some degree of elasticity, after it pushes through and exits the restricted diameter, the ball substantially returns to its original diameter OD. Thus, ball 24 after it passes out of sleeve 22 can be used to act against another tool downhole of that sleeve 22. If the ball is relatively inelastic, but plastically deformable, such as aluminum, the ball yields during passage through the sleeve, but can also be used to act against another tool downhole.

The ID through the sleeve in this embodiment is a substantially smooth bore, but the interference fit between the ball and the inner diameter requires that the ball squeeze through the smooth ID, against the force of friction and resistance to material deformation, and in so doing creates a force against the sleeve, which actuates the sleeve. The force generated is selectable and may be any value: for example 1000 lbs to 10000 lbs, but the actuator, for example, by selection of shear pins 50, can be selected to sense and respond to that force.

Ball 24 can include or be formed entirely of various deformable materials such as metals, ceramics, plastics, rubber, etc. Further details of useful balls will be discussed hereinbelow.

This invention simplifies downhole actuation of tools over those with sleeves having deformable, repeating or convertible seats. In this invention, an actuation ball is selected to be deformable, for example able to deform, and possibly elastically regain its shape, a plurality of times, and the actuation ball is formed to withstand a certain amount of force to squeeze through the restricted diameter of the sleeve of a downhole tool to actuate that downhole tool. Thus, the ball, rather than the seat, converts at least temporarily to actuate the tool having the sleeve of restricted diameter. The sleeve of the basic actuator substantially does not deform, convert or reconfigure when the ball passes through but instead the ball deforms. The sleeve inner bore can be made of materials such as steel, aluminum, ceramics, so while the inner diameter restriction in these embodiments can be deformable to some degree, the emphasis is on the relative deformability of the ball. The ball moves through the restriction of the sleeve without being destroyed and substantially without being adversely damaged. Thus, if desired, the ball can be used again further down to actuate another tool. As the ball moves through the restricted diameter of the sleeve, the ball creates a force that actuates a tool mechanism.

While the actuator of FIGS. 1A to 1D illustrates a single cycle tool actuator, wherein the ball that lands directly actuates sleeve 22 to expose ports 17, the ball could act on an actuator tool in other ways. For example, in one embodiment, the actuator with deformable ball technology may be employed in a tool that is selected to undergo a plurality of actuations downhole before being actuated into a final position. For example, the deformable ball may be employed to cycle the actuator through one or more inactive conditions before being configured into an active condition. Such cycling can be achieved by use of an indexing mechanism, also called a ball counter, in the actuator. Such an actuator may be intended to react to the passage of a plurality of plugs, wherein each plug that squeezes through, actuates the actuator through one cycle until finally a plug squeezes through that moves the actuator into an active condition. A common indexing mechanism includes a J-slot, but other indexing mechanisms based on J-slot concepts are available such as those employing a crown ratchet or an axial walking ball counter, etc. Using a J-slot, for example, the pressure generated by landing the ball in the sleeve forces the actuator to move down against the bias of the indexing mechanism. When the limit of the indexing mechanism's bias is reached, the ball passes through the sleeve. Thereafter, the bias in the indexing mechanism moves the actuator to either another inactive position (to be cycled again) or to an active position.

For example, another actuator 110 is shown in FIGS. 2A to 2F, that includes an indexing mechanism 160. When a ball passes and creates a force against the actuator, it will be cycled through one of its inactive (also called passive) stages and finally into an active condition. The actuator of FIG. 2, includes a sleeve 122, positionable over a plurality of ports 117 to close them against fluid flow therethrough. Sleeve 122 is moveable from a closed port position (FIG. 2A), wherein the ports are covered by the sleeve, through one or more inactive conditions (FIGS. 2C and 2D), wherein the ports remain covered by the sleeve, and finally to an active condition, which is this embodiment is a port-exposed position (FIG. 2F) wherein ports 117 are exposed to bore 145 and fluid from the inner bore can contact, and if they are open pass through, the ports.

Figures 2A, 2B, 2C, 2D:
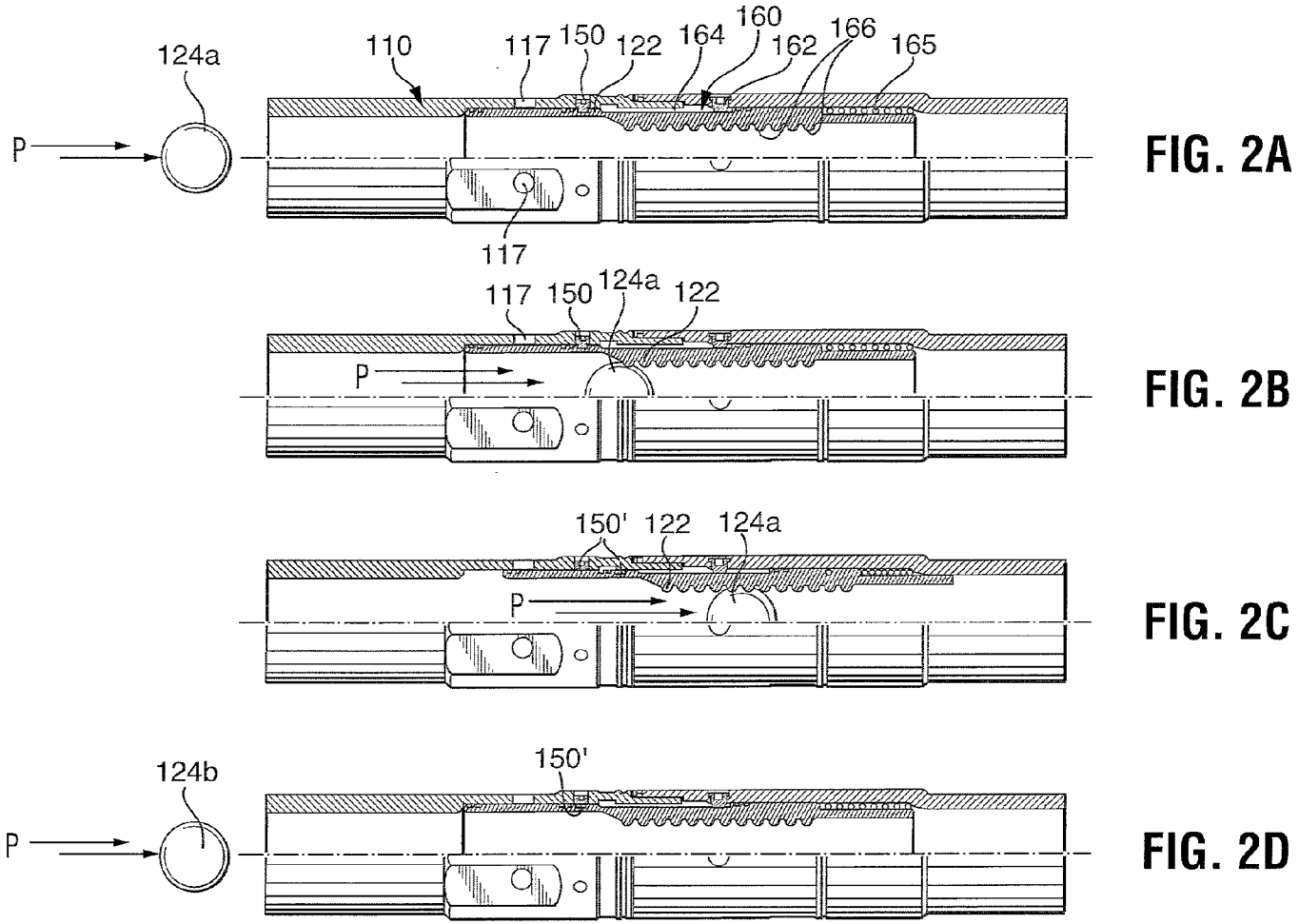
FIGS. 2A to 2F are a series of sectional views through a wellbore actuator according to an aspect of the present invention.
Figure 2E:
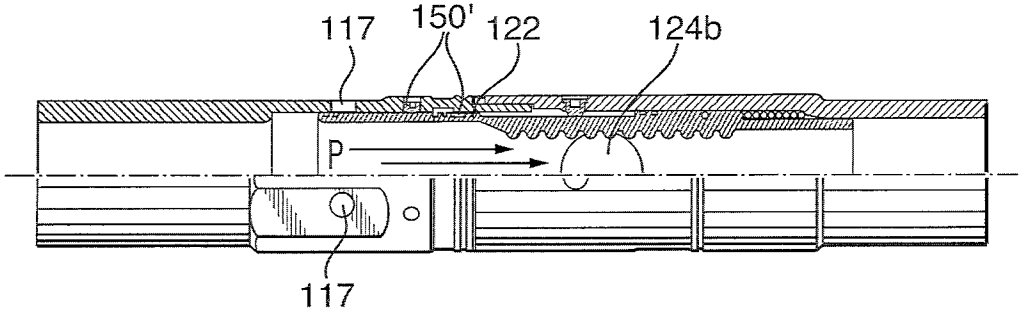
Figure 2F:
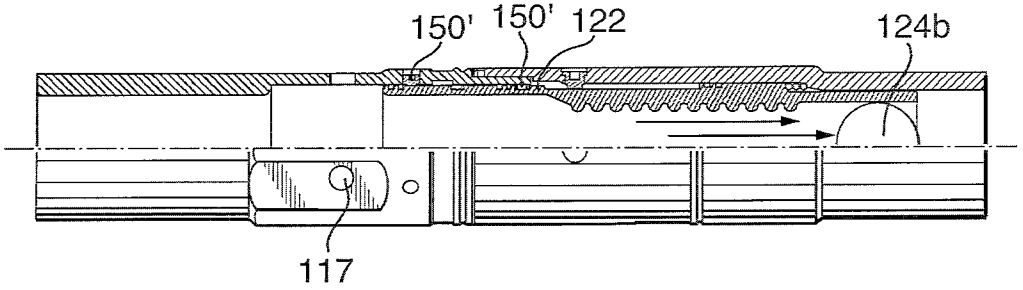

The sleeve is actuated by balls 124*a*, 124*b* that can pass through the tubing string to actuator 110 and are sized to each have a normal outer diameter greater than the inner diameter of sleeve 122, but which are each deformable to be capable of being forced through the sleeve by fluid pressure. As a result of the pressure P acting against the balls and the balls' material softness, they are each deformed and squeeze through the sleeve. As each ball squeezes through the sleeve, an axial force is applied to the sleeve. For example, the first ball 124*a* passing through the actuator lands in the sleeve (FIG. 2B), creates a force on sleeve 122 that is sufficient to shear any holding pins 150 (shown sheared as 150') and to move the sleeve one cycle through the indexing mechanism (FIG. 2C), for example against any bias in the indexing mechanism. The sleeve can only move into the active condition as permitted by the indexing mechanism. In the illustrated embodiment, the indexing mechanism has only one inactive condition and after first ball 124*a* passes, the sleeve returns through its biasing force to an inactive condition (FIG. 2D) with sleeve 122 still covering the ports 117. When the next ball 124*b* lands and squeezes through the sleeve, the sleeve is moved axially into an active condition, which in this embodiment is a port-exposed position (FIG. 2F). The sleeve may be locked in this state by a lock 152.

Balls 124*a*, 124*b*, in this embodiment being substantially resilient, each return substantially to their original diameter after passing sleeve 122 and can each continue down to actuate further tools.

While indexing mechanism 160 is shown here as a J-slot with a pin 162 in a walking J-slot 164 and biased by spring 165, it may take other forms, such as employing a mechanism using crown or axially extending ratchets, to count balls passing through. The indexing mechanism could have any number of inactive conditions through which the actuator must cycle before arriving at the final, active condition.

While the sleeve restriction in FIG. 1A is defined by a substantially smooth bore, FIG. 2 show another option, wherein the inner diameter through sleeve 122 remains substantially non-deforming but includes inconsistencies such as a series of protrusions 166 on the inner diameter with inwardly extending bumps having smooth or sharp angles. For example, there may be threads, waves, grooves, fins, teeth, corrugations, etc. formed into the inner diameter of the sleeve, which have surfaces that protrude inwardly so that the ball catches and advances a number of times as it moves through the inner diameter. While the movement of the ball through the inner diameter happens quickly, a sufficient force is created by this graduated advancement caused by the ball catching on the inner diameter. The structures causing the ball to catch on the inner diameter could be arranged and spaced in various ways. For example, as shown, substantially annular ridges may be formed on the inner diameter and may be spaced regularly (i.e. every quarter or half an inch).

The force that is generated by the passage of the balls through the sleeve is set by selection of the ball material, fluid pressure, sleeve inner diameter surface and the relative size of the ball and the sleeve inner diameter and may be any value of interest to the operator: for example 1000 lbs to 10000 lbs, but the actuator, for example, by selection of shear pins 50 and the biasing strength of the biasing member, can be selected to respond to and be actuated by that force.

In one example, for a tool that cycles through a number of inactive positions, a final active condition may be reached where the sleeve moves to open the port, as shown in FIG. 2F. Alternately, the final active condition may be a state where a seat forms in the tool. The tool may have an indexing system, like a J-slot, that permits the tool to be moved through a number, for example ten, inactive cycles, and then eventually the tool moves into an active condition, where at the end of the indexing, a plurality of protrusions, such as fingers or dogs, could be exposed on the tool, in or adjacent the ID restriction. Thus, the final seat is presented and ready to catch a ball conveyed through the string.

Wellbore actuators 10, 110 may be used alone in a string, if desired. Alternately, the wellbore actuators may be installed in a string with other similar or different actuators. For example, since the ball used to actuate the actuator is resilient, wellbore actuator 10 and/or wellbore actuator 110 may be employed in a string with one or more further actuators that in sequence are all actuated by the same ball as it passes. There may be a plurality of groups of actuators, wherein the actuators in one group are actuated by the same ball as it passes, but the actuators in another group are actuated by a different sized ball. When the wellbore actuators are used in series with a one or more groups of actuators actuated by a different sized ball, the lower groups of actuators in the tubing string have inner diameters selected to be actuated by balls having diameters less than the inner diameter of the upper actuators, so that the balls to actuate the lower actuators are able to pass through the upper actuators substantially unrestricted.

For example, in one embodiment, the deformable ball technology may be employed for a group of actuators that are each single cycle tools, similar to that shown in FIG. 1A. In one embodiment, where it is desired to inject fluid through a plurality of ports axially spaced apart along a length of a string, the ports can each have a closure positioned thereover that can be opened by the deformable ball applying a force against each closure as it passes through. The deformable ball may apply a force to a first closure, open that closure, pass to the next closure, open that closure, etc. and while each application of force includes the deformation of the ball, the ball regains its form after passing the closure to be ready to actuate the next closure it reaches. The closures may take various forms, such as kobe subs, sleeves, etc.

In one such embodiment, for example, the ball, as it passes through the string, may actuate each actuator to move a sleeve thereon. For example, with reference to FIG. 3, a wellbore treatment assembly is shown installed in a wellbore 212. The wellbore may be open hole (uncased), as shown, cased, vertical, non-vertical, etc.

The wellbore treatment assembly includes a tubing string 215 with one end 215*a* extending towards surface and one end extending into the toe of the well. The string carries a plurality of actuators 210*a*-210*d* spaced along its length, each with a sliding sleeve. Thus, string 215 includes a plurality of sliding sleeves 222*a*, 222*b*, 222*c*, 222*d*, each with an inner diameter IDs of substantially the same size. The diameter IDs is less than the normal inner diameter IDd of the string such that the plurality of actuators are selected to be acted upon by a deformable ball 224 having an outer diameter greater than IDs but less than IDd. The plurality of actuators 210*a*-210*d* can be actuated in sequence to expose all of ports 217*a*-217*d* in one pass of ball 224. As the ball squeezes through each sleeve, that sleeve will be actuated. Ball 224 then passes along string 215 to the next sleeve, is forced through that sleeve by fluid pressure and moves that sleeve and so on until all the sleeves have been moved to expose the ports. For example, after ball 224 is released from surface it is fluid conveyed through the inner bore of the string. When ball 224 reaches sleeve 222*a*, it will squeeze through that sleeve and actuate it to move and expose ports 217*a*. Ball 224 then passes along string 215 to the next sleeve 222*b*, is forced through and moves that sleeve by fluid pressure. This exposes ports 217*b*. The ball then continues on and squeezes through the remaining sleeves 222*c* and 222*d* until all the sleeves have been moved to expose the ports. Although the ball is deformed during its passage through each sleeve, sleeve 222*a* for example, the ball is resilient and reforms to be ready to actuate the next sleeve 222*b* and so on.

To ensure that there is sufficient pressure to keep ball 224 moving, and thereby sufficient pressure to apply force to the sleeves, the actuators may include delay opening mechanisms for at least the upper ports 217*a*, 217*b*, 217*c*. In such an embodiment, the string may include delay opening mechanisms in the closures, such that the closures only move fully to expose or to open their ports after a delay. Alternately, the ports may include limited entry inserts such as one or more of flow restrictors, nozzles, pressure sensitive plugs, erodible plugs, etc. to restrict flow from the ports after they are exposed.

It is noted that sleeve 222*d* includes a formable seat thereon. The sleeve includes a plurality of protrusions 223, such as fingers or dogs, that are normally in an inactive condition but are actuable to an inwardly protruding condition when sleeve is moved. When in an inwardly protruding condition, the protrusions stop the ball from further movement through the string and permit the creation of a seal with the ball so that fluid can be diverted to the ports 217*a*-*c*. Thus, when sleeve 222*d* is moved by the squeezing force of ball 224, a final ball seat is presented and ready to stop the ball from being further conveyed through the string.

The string may be employed for staged wellbore treatment and may include one or more packers 220 that divide the wellbore annulus 213 into isolated intervals. The ports of one or more actuators provide access to the isolated intervals from within the tubing string, when the ports are exposed and opened. The packers can take various forms and may, for example, be solid body, hydraulically set, etc. Generally, the packers are set to create the isolated intervals before the operator begins to actuate the actuators.

Note that more than four actuators can be run in a string. For example, the string may contain more actuators similar to actuators 210*a*-*d*. Alternately or in addition, further actuators or groups of actuators similar to the actuators 210*a*-*d* shown here but having a different IDs may also be incorporated in the string. Any actuators downhole of actuators 210*a*-*d* that have a different IDs are actuated by a ball smaller than ball 224 so that the smaller ball can pass through sleeves 222*a*-*d* without actuating them.

In another embodiment, the deformable ball technology may be employed in a repeat acting tool, for example, to shift a tool, such as a port closure, through a series of passive and active conditions. An actuator that moves through a plurality of passive and active shifts is disclosed in FIG. 2 above. FIG. 4 show a tubing string including a group of such actuators, all actuated by the same ball. For example, FIGS. 4A to 4F show a method and system to allow several sliding sleeve valves to be run in a well, and to be selectively activated by the same size ball. The system and method employs actuators such as, for example, that shown in FIG. 2 that will shift through one or more inactive shifting cycles (FIGS. 2B to 2D) before being capable of moving into an active condition (FIGS. 2E and 2F). Once in the active condition, the valve has either shifted or can be shifted from a closed to an open position, and thereby allow fluid placement through the open ports from the tubing to the annulus. This illustrated embodiment also includes one single cycle actuator, for example, similar to that of FIG. 1A.

Figure 4A:
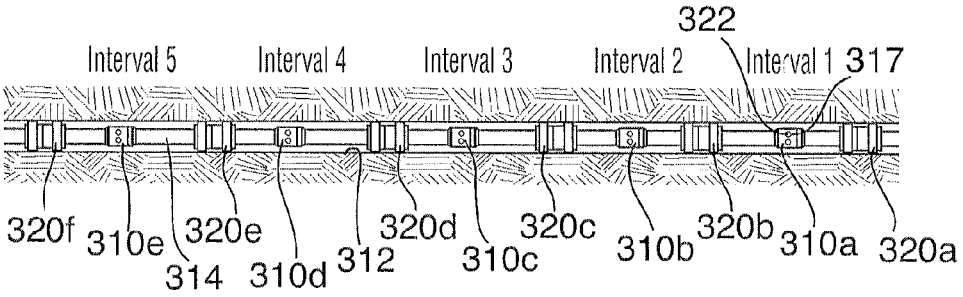
FIGS. 4A to 4F are a series of sectional views through a wellbore with a wellbore fluid treatment apparatus according to an aspect of the present invention installed therein, the series of views also show a method according to an aspect of the invention.

FIG. 4A shows a tubing string 314 in a wellbore 312. A plurality of packers 320*a*-*f* can be expanded about the tubing string to segment the wellbore into a plurality of zones. In this wellbore, the wellbore wall is the exposed formation along the length between packers. The string may be considered to have a plurality of intervals 1-5, each interval defined as the space between each adjacent pair of packers. Each interval includes at least one actuator 310*a*-*e*, each of which include a port 317 (can be seen in this view) and a sliding sleeve valve 322 thereover (can only be seen through closed ports in this view as the sleeve in this embodiment is within the string). Actuators 310*b*-*e* also include an indexing mechanism controlling movements of their sleeves.

Each sliding sleeve valve includes a restricted inner diameter that permits a deformable plug-driven movement of the sleeve, as fully described above. All of the sliding sleeve valves of actuators 310*b* to 310*e* have inner diameters of the same size, such that one ball can pass through and actuate all of them.

Initially, as shown in FIG. 4A, all ports are in the closed position, wherein they are closed by their respective sliding sleeve valves being positioned thereover.

Figure 4B:
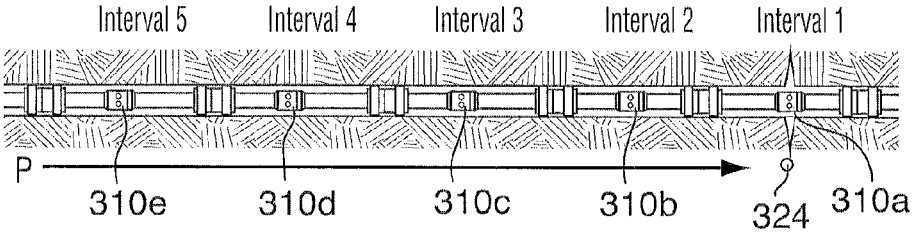

As shown in FIG. 4B, a ball 324 may be pumped, arrow P, through the sleeve of actuator 310*a* to expose or, as shown, possibly open and treat through the port accessing Interval 1. When the ball passes through the sleeves of actuators 310*b*-*e* in Intervals 5, 4, 3 and 2, there is a passive shift of each sleeve through its indexing mechanism. When the ball passes through the actuator of Interval 2, it actuates that sleeve into the penultimate position of its indexing mechanism such that it is only one actuation from its active, exposed-port position and it can be opened when desired by passing one more ball therethrough.

Figure 4C:
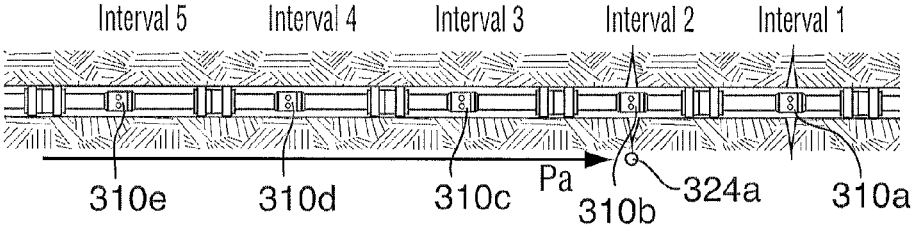

For example, as shown in FIG. 4C, in a next step, a ball 324*a* is then pumped, arrow Pa, through the string and through the sleeve of actuator 310*b* to expose or possibly open the port in Interval 2. When ball 324*a* passes through the sleeves in Intervals 5, and 4, they each make a passive shift as controlled by their indexing mechanisms. When the ball passes through Interval 3, it moves the sleeve of actuator 310*c* into its penultimate, inactive condition so that it can be shifted to the port-exposed/open position when desired by dropping one more ball.

Figure 4D:
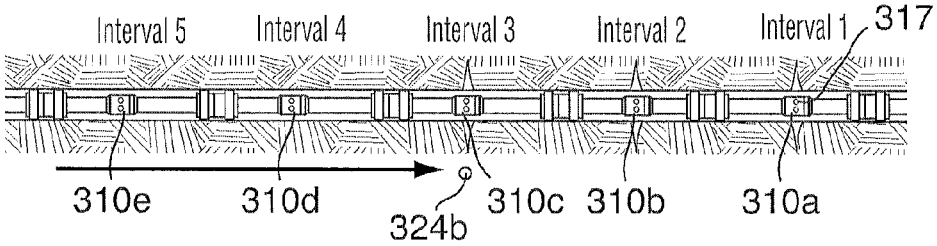

Thereafter, as shown in FIG. 4D, a ball 324*b* is introduced to the string and fluid conveyed by pumping through the sleeve of actuator 310*c* to expose/open the port in Interval 3. When ball 324*b* passes through the sleeve in actuator 310*e* of Interval 5, that sleeve makes a passive shift. When the ball passes through Interval 4, it moves the sleeve therein into its penultimate inactive condition so that it can be shifted to the exposed/open position when desired.

Figure 4E:
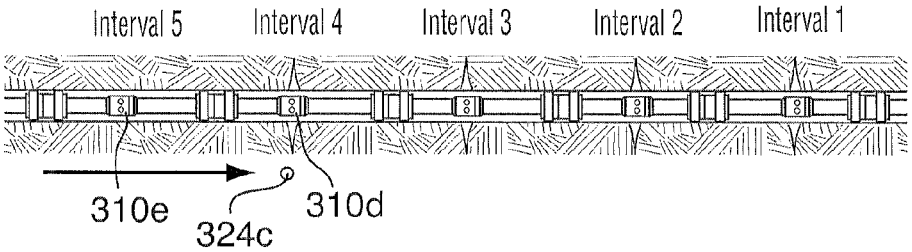

Thereafter, as shown in FIG. 4E, a ball 324*c* is pumped through the sleeve of actuator 310*d*, which is in its penultimate inactive condition, to open the port in Interval 4. When ball 324*c* passes through Interval 5, it moves sleeve 310*e* into its penultimate inactive condition so that it can be shifted to the exposed/open position when desired.

Figure 4F:
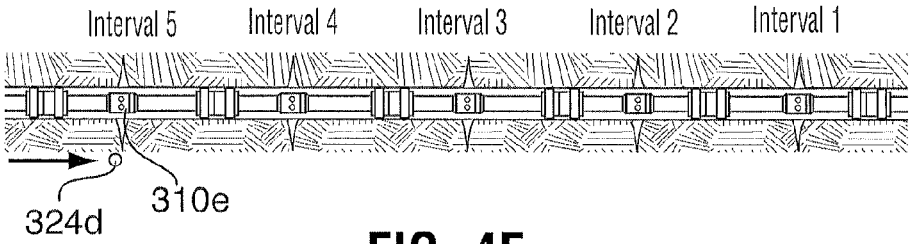

Thereafter, as shown in FIG. 4F, a ball 324*d* is introduced and pumped through string 315 to the sleeve of actuator 310*e* to open the port in Interval 5 completing the actuation of all the actuators to the active, port-exposed/opened positions.

It will be noted that the indexing mechanism of actuator 310*e* will be set to have more inactive positions than those actuators downhole of it.

Note that more than five actuators can be run in a string and a string may include more groups of actuators that are actuated by a different diameter ball. To actuate an actuator of a different group below actuators 310*a-e*, a smaller diameter ball is conveyed through actuators 310*a-e* which does not create sufficient force when passing therethrough to create any effect thereon.

When the ports are each opened, the formation accessed therethrough can be stimulated as by fracturing. The intervals can be treated directly after their sleeves are moved into the port-exposed, opened positions or after all ports are exposed/opened as desired. It is noted, therefore, that the formation can be treated in a focused, staged manner. It is also noted that balls 324-324*d* may all be the same size. The intervals need not be directly adjacent as shown but can be spaced.

This system and tool of FIG. 4 allows single sized plugs, for example, balls 324 to 324*d* to function numerous valves. The system may be activated using an indexing mechanism, as noted. The system allows for installations of fluid placement liners of very long length forming large numbers of separately accessible wellbore zones.

In some embodiments, it may be useful to have, or eventually form, a seat in the string against which a sealing device can be landed to produce a maintainable force or to produce a seal against fluid flow, for example to divert fluid to exposed or opened ports. Thus, while an ID restriction, as described above, may be useful to create a force on a tool in the string, the ID restriction is formed to allow the ball to pass and thus a maintainable pressure may be difficult to achieve. A seat, either set as run in or formable, to act as a blocking mechanism against which a ball can seal may, therefore, be of interest.

Figure 3:
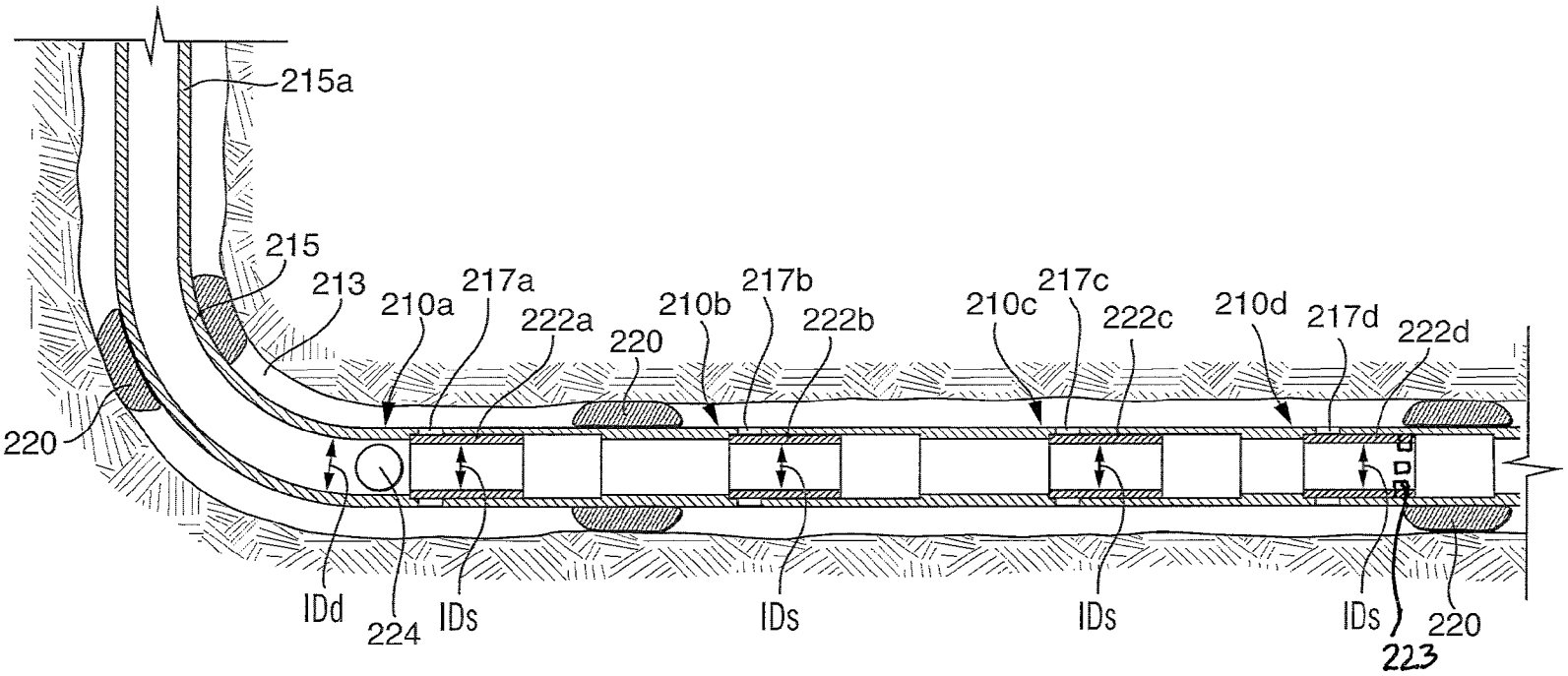
FIG. 3 is a sectional view through a wellbore with a wellbore fluid treatment apparatus according to an aspect of the present invention installed therein
Figure 5A:
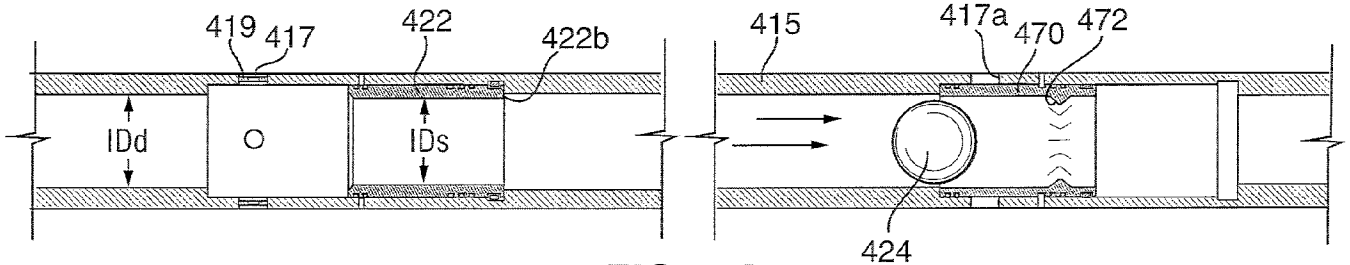
FIGS. 5A and 5B are sectional views through a wellbore apparatus according to another aspect of the present invention, the series of views show a method according to an aspect of the invention.
Figure 5B:
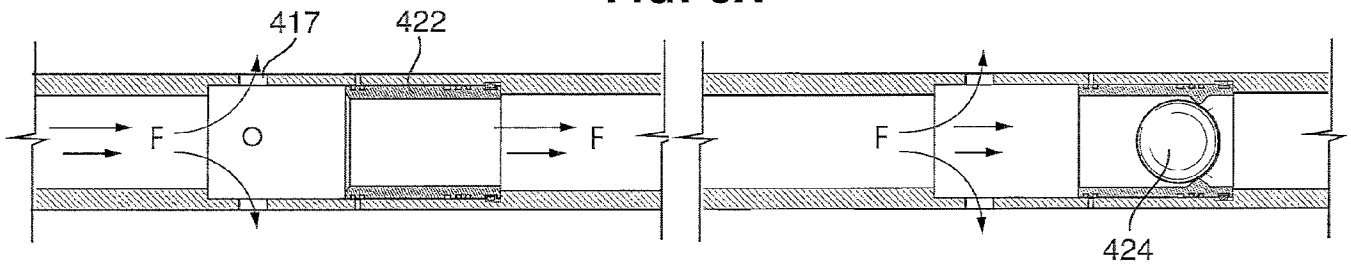

In embodiments of this invention such as FIGS. 3 and 4, for example, the string accommodating an actuator may include a solid seat (set as run in) downhole of the actuator to catch a ball and divert fluid to the opened ports. The solid seat may be on an actuator, such as a sleeve covering ports, or may simply be fixed in the string. With reference to FIGS. 5A and 5B, for example, a tubing string 415 may be provided that includes an actuator 410, as described above, with a inner diameter restriction IDs smaller than the normal inner diameter through the string and a ball-driven port opening tool including a sliding sleeve valve 470 with a ball stop formed as a solid seat 472. Valve 470 is moveable along the string's axis to expose fluid ports 417*a*. A deformable ball 424 is employed to actuate both actuator 410 and sliding sleeve valve 470. Ball 424 may be launched to land in, squeeze through and thereby shift the sleeve 422 of actuator 410 to expose its port 417. Once the ball is released from the actuator, which may be positioned in string 415 alone or as one of a group of actuators actuated by that ball, ball 424 is pumped along the string to ball seat 472 (FIG. 5A).

Ball seat 472 has a diameter thereacross that retains ball 424 and does not allow the ball to pass through. For example, ball seat 472 has a diameter less than IDs. Thus, once the ball hits the ball seat a pressure differential is generated that forces sleeve valve 422 to shift and opens port 417*a*. Ball 424 remains in seat 472 and provides isolation from the tubing below the ball seat. Thus, fluid is diverted to port 417*a* and port 417 and any further exposed ports of actuators uphole. A wellbore fluid treatment can proceed, which fluid is injected from the tubing string through ports 417, 417*a* to the wellbore to fluid treat, for example, fracture the formation accessed by the wellbore.

Port 417 includes a limited entry insert 419 such as a restriction, a nozzle, a pressure sensitive plug, an erodible plug, etc. to at least initially restrict flow from the port after it is exposed. This ensures that pressure can be maintained in the string at least until ball 424 seals on the ball seat 472. In this embodiment, insert 419 is removable such that eventually, the insert opens sufficiently to allow fluid, arrows F, to pass through port 417 to treat the well.

Figure 6:
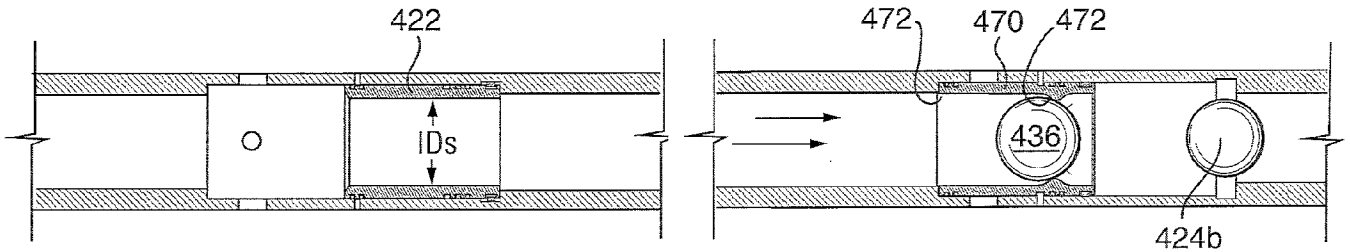
FIG. 6 is a sectional view through a wellbore fluid treatment apparatus according to another aspect of the present invention.

Ball 424 is stopped and retained by seat 472 until the pressure differential across ball 424/seat 472 dissipates. While ball is deformable, it can't sufficiently deform to pass the seat 472. In some embodiments, a ball to be useful for pressure diversion must be capable of withstanding 1500 psi to 10000 psi differential without failure. For example, a 3.75" ball generally is required to 10000 psi differential without failure to be useful for pressure diversion against a fixed seat. Thus, alternately, as shown in FIG. 6, another substantially non-deformable ball 436 could be launched for the purpose of sealing in seat 472, while the first ball 424 passes therethrough. Again, ball seat 472 has a diameter less than IDs so that ball 436 can be sized to pass through the sleeve 422 but will be retained by and seal against seat 472.

If a formable seat is of interest, the sleeve or another actuator can include a seat form that is initially inactive but can be urged inwardly to create a seat by manipulation downhole. For example, the sleeve or another actuator can include a plurality of protrusions, such as fingers or dogs, that through manipulation for example a mechanical shift are exposed, for example biased inwardly into the bore of the tool. Thus, the final seat is presented and ready to catch a ball conveyed through the string and create a maintainable pressure therewith.

Thus, in the use of the present system, the tools residing downhole in the string need not have convertible/deformable seats, but rather have a substantially non-deformable restriction, for example a sleeve with a diameter reduced relative to the strings long axis, that can act with a ball to create a reliable force by the ball passing therethrough and the tools include a mechanism for registering and reacting to the force created. The ball however, can repeatedly act as it passes along the string to create a force as it passes a plurality of tools. Each time the ball passes a tool, it can create a force and in so doing is deformed to some degree. However, the ball regains its form after it passes that tool and is ready to act on a next tool that has an ID restriction to catch the ball. The string may include a seat to catch a ball and create a maintainable seal with it. The ball may be the deformable ball or another ball launched solely for the purpose of the sealing on the seat. The seat may be set in the well during run in or may be formed by manipulations downhole. For example, at least one of the tools in the string, if desired, can include a mechanism for eventually forming a seat to catch a ball.

Thus a method is provided to actuate a plurality of tools along a tubing string, such as to open a plurality of ports for example, for multizone stimulation to pump fluid through the plurality of opened ports to stimulate a reservoir. In some cases it is desired to open multiple ports at once to stimulate all at once. Alternately, the method may require a tool to be cycled through a plurality of inactive conditions before opening.

According to this method a ball can be dropped that can provide the force to actuate the tool, open a port or cycle a tool from one inactive condition to a next state, then pass on to the next tool and actuate it without needing a complicated mechanism in the tool itself. In fact the tool itself may simply include a simple, for example one part, sleeve with a fixed ID restriction and no other moving parts on the sleeve ID.

Once the ball has actuated all of the tools of interest, in one embodiment, the method includes landing the ball on a seat through which it cannot pass. This seat might have been installed in the well at run in or may have been formed by the actuation system of a deformable ball on a tool. The seat may be fixed, serving only to stop the ball, or the seat could be connected to an actuation system, for example to provide the force to open a last port needed for the stimulation of this section of the well. The seat may be formed to hold pressure, for example to create a seal, with the ball. Thus, the seat may have a substantially continuous circular, such as frustoconical, form. The seat itself may have a deformable surface such that it can create a seal even with a ball that has been worn by passing through one or more sleeve ID restrictions.

The deformable balls used to pass through the ID restriction of the actuator in this embodiment are resilient. They have some elasticity such that while they may be subjected to some degree of deformation, they substantially resume their original shape after the force causing deformation is removed. Sometimes, the ball may undergo wear or minimal plastic deformation when passing through a seat, but the ball tends to substantially resume its original form. For example, while an interference fit of 0.005 to 0.030", or about 0.010 to 0.020", for the ball relative to the sleeve ID is suitable to reliably achieve a force, the ball may be deformed by wear or plastic deformation for example to reduce the diameter by up to 0.010" (i.e. the deformation may be in a ring around the ball, where it has contacted the sleeve ID as it passed through) and still reliably create an actuation force in further sleeves and/or against a solid seat downhole.

As noted, the ball may be formed of various deformable materials such as metals, ceramics, plastics or rubber. The ball material may be reinforced, filled, etc. to ensure the characteristics of deformability and durability at wellbore conditions. Some materials that have been found to produce useful balls are: soft metals such as aluminum; polymers such as fluoropolymers and composites thereof, including any or all of polytetrafluoroethylene (PTFE), perfluoroalkoxy (PFA), fluorinated ethylene propylene (FEP) with graphite, molybdenum disulfide, silicone, etc; polymers such as polyesters or polyurethanes, such as polyglycolic acid, etc. Such materials may, in addition to their deformability, provide for low friction, durability and wear resistance. It may be useful to use materials softer than phenolic resins, as phenolic materials have been found to fail rather than reliably squeeze through the usual materials sleeve materials: cast iron and mild steel.

Figure 7:
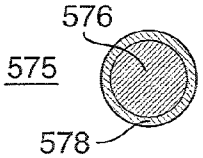
FIG. 7 is a sectional view through an actuator ball useful in the present invention.

While the ball may be entirely formed of a single material, if desired as shown in FIG. 7, a ball 575 may be formed of a plurality of components. In one embodiment, for example, ball 575 includes a core 576 and an outer coating 578. The multi-part construction may serve various purposes depending on the effect that is desired. In one embodiment, the multi-part construction is used to coat a core against adverse chemical reactions or mechanical damage. For example, the core may be coated to protect it against acidic, oxidizing or hydrolytic degradation or to provide the ball with greater abrasion resistance than that the core on its own possesses. In another embodiment, the multi-part construction is employed to select for preferred features of the ball's interaction with the sleeve. For example, a core can be employed that is of interest for properties, such as hardness, and a more abrasion resistant, softer and/or lower friction outer coating 578 can be coated on the core. For example, in one embodiment, an aluminum or ceramic core (solid or hollow) can be employed that is relatively hard and substantially non-deformable and a softer and/or lower friction and/or more chemically resilient outer coating 578, such as including a fluoropolymer, can be coated on the core. In such an embodiment, outer coating 578 can substantially resiliently deform to pass though the restriction of a tool and provides a low friction and wear resistant surface, and the inner core may limit the deformation of the ball during the squeeze and/or may prevent the ball from passing through a final seat, such as seat 472 of FIG. 5A, on which the ball is to stop and create a seal. Thus, even though the outer coating may deform, the core provides the ball with some resistance to ready deformation and, for example, cannot pass through the final seat because it has a diameter that is greater than the diameter of the final seat and cannot deform to the degree required to pass through the seat. Thus, the harder inner core can hold higher pressures substantially without deformation, while the outer layer would deform as it passes through the ID restrictions of actuators such as sleeve 422 of FIG. 5A. The final seat 472 may be a seat already set in the well during run in, as described above in FIG. 5, or a seat formed after manipulation downhole, as noted above.

It may be useful to consider flow back characteristics of the system. In particular, while flow back pressures may be sufficient to push the ball uphole, they may be inadequate to force the ball to deform and pass up through an ID restriction, such as the sleeves described above. If it is intended to flow the well back after actuating the actuators, it may be desirable to configure the actuator assembly to prevent the ball from sealing against the downhole side of the ID restriction (see end 422*b* of the sleeve of FIG. 5A) when the well is flowed back.

In one embodiment, for example, the ball is selected to become reduced in outer diameter at least to some degree at wellbore conditions such that after a residence time downhole it becomes shaped to avoid seating on the underside of the ID restriction. The ball can, for example, become non-rounded, angularly shaped, perforated, etc. such that it cannot seat and seal off against the downhole side of the seat. Alternately or in addition, the ball can change shape by an overall reduction in outer diameter so that it can readily pass through the ID restriction. To achieve the shape change, the ball may be formed of a material able to eventually breakdown at wellbore conditions, such as degradable (frangible or dissolvable) materials. While the ball is deformable and able to retain its shape during pumping downhole, for example, to squeeze through and actuate the sleeve, the ball is formed of a material that breaks down by dissolving, flaking, etc. after a residence time downhole.

The ball may be formed entirely or partially of the material able to break down at wellbore conditions. If partially formed of the material able to break down, the degradable material could be filled in about or around a remaining body portion. The remaining body portion could be a skeleton or a collapsible outer shell within or about which the degradable material is applied or an inner core about which the degradable material is applied as an outer layer of the ball such as outer coating 578 of FIG. 7. The remaining body portion, which remains after the degradable material is broken down, may be formed to pass through the ID restriction or have perforations or an angular form to prevent the body portion from sealing against the downhole side of the ID restriction.

In one embodiment, a degradable material may be employed such as a material that can be degraded by contact with wellbore or introduced fluids. For example, some materials exhibit acidic or hydrolytic instability such as an electrolytic metallic material or a hydrolytically unstable polymer. The degradable material may be selected to be stable for at least the time it takes for the ball to be conveyed downhole and to actuate a tool, before degradation thereof. Generally, a material that starts to break down after 6 hours and is reduced to a flow back size in less than a month is suitable.

For example, a polyglycolic acid may be employed to form the entire ball or a coating thereof, which begins to break down in the presence of water after a particular residence time, such as one day. One polyglycolic acid begins to break down in the presence of water at greater than 150° F. and within a month degrades into small flakes (<½" or even <⅛"), having a size much smaller than any ID restriction and small enough to be conveyed readily in back flowing fluids.

In another embodiment, the ID restriction can come to have an enlarged inner diameter at wellbore conditions such that after a residence time downhole the ID restriction becomes shaped to prevent a ball from seating on the underside of the ID restriction. The ID restriction can, for example, become non-circular, angularly shaped, perforated, etc. such that a ball cannot seal thereagainst. Alternately or in addition, the ID restriction can retain its circular shape but can degrade such that the inner diameter becomes enlarged so that the ball that previously squeezed through the ID restriction can readily pass. To achieve the shape change, the ID restriction includes at least an inner diameter portion formed of a material able to eventually breakdown at wellbore conditions. Such materials may be degradable, as described above.

The ID restriction may be formed entirely or partially of the material able to break down at wellbore conditions. If partially formed of the degradable material, it could be filled within or around a remaining body portion. The remaining body portion could be a skeleton or an outer layer within or about which the degradable material is applied. The body portion, which remains after the degradable material is broken down, may be formed or sized to stop the ball, but not to create a seal with it, or may be formed or sized to allow the ball to pass through by the pressures of back flow.

In one embodiment, a degradable material may be employed such as a material that can be degraded by contact with wellbore, or introduced, fluids. For example, some materials exhibit acidic or hydrolytic instability such as an electrolytic metallic material or a hydrolytically unstable polymer. The degradable material may be selected to only degrade after a time suitable for the ID restriction to accept ball actuation. Generally, a material that starts to break down after a day and is reduced to a size permitting flow back in less than a month is suitable. For example, all or a portion of the ID restriction, for example, all or a portion of the small diameter restriction or of the sleeve in its entirety, may be constructed of a degradable metal, such as an aluminum magnesium alloy, which breaks down in the presence of water after a particular residence time.

In one embodiment, the inner diameter of the ID restriction is coated with a protector that protects the degradable material from contact with the reactive fluid until after a ball has passed. For example, the protector can be a chemical, for example water, resistant material that isolates the degradable material from the reactive chemical. The protector however, may be removable by residence time or abrasion to eventually allow the reactive chemical to contact the degradable material of the ID restriction. For example, in one embodiment, the protector is a thin coating on the inner diameter of the sleeve and is removed by the abrasive forces of the ball being pushed through the sleeve. Thus, once a ball passes through the sleeve, the sleeve begins to degrade.

Figure 9:
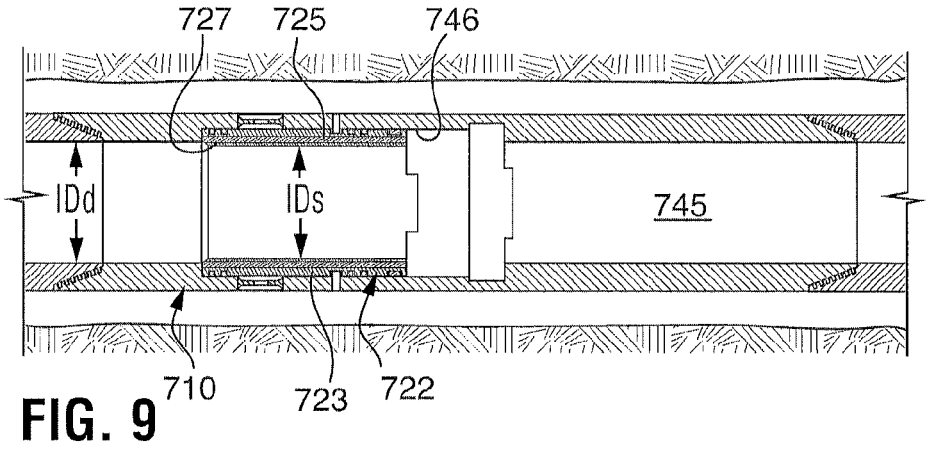
FIG. 9 shows another wellbore apparatus according to the invention.

FIG. 9 shows a wellbore tool 710 with a degradable sleeve installed therein for axial movement. The tool includes a tubular body 744 and a sleeve 722 installed in the bore of the tubular body. Sleeve 722 is positioned in an annular recess 746 in the inner wall of the tubular body and is axially moveable therein. The sleeve includes an outer shell 723 that is filled with a degradable material 725. The degradable material forms a seat 742 that protrudes into the inner bore 745 of the tubular body and creates a restriction IDs therein. A protective coating 727 covers all exposed surfaces of material 725. Once the protective coating is compromised, as by the landing of, or abrasion of, a ball thereagainst, material 725 can be contacted by the fluid causing degradation and the material can degrade with residence time in the well. Since the material forms the portions of the sleeve that protrude into the inner bore, the inner bore becomes opened to substantially its drift diameter IDd by degradation of material 725.

It is to be appreciated that this degradable sleeve technology could be employed with deformable balls or with sleeves intended to stop the ball, such as sleeve 470 or seat 472 of FIG. 5A. It will also be appreciated that the entire sleeve may be formed of degradable material.

In another embodiment, the actuator or the string may include a ball catcher that prevents the ball from seating and sealing against the downhole side of the ID restriction. For example, with reference to FIG. 8, an actuator 610 is shown that serves to prevent the ball from seating and sealing against the underside of an actuator's ID restriction through its sleeve 622. Actuator 610 is similar in many ways to the actuator of FIG. 1A. Actuator 610 is formed as a tubing string sub that can be secured into a wellbore string. The sub includes a tubular wall having an outer surface and an inner wall surface that defines an inner bore 645 of the sub. One or more ports 617 are positioned in the wall and, when open, provide for fluid communication between inner bore 645 and the outer surface of the wall. The sub includes ends for connection into a tubing string. The ends may, for example, be threaded for normal connection to other subs forming the string.

The sub includes sleeve 622, which is axially moveable in the bore from the closed port position (FIG. 8A), wherein port 617 is covered by the sleeve, and to a port exposed position (FIGS. 8B and 8C), wherein port 617 is exposed to bore 645 and fluid from the inner bore can contact the ports. The port when initially exposed may be plugged (as shown) by an insert 619 or already open to some degree. If/when port 617 is open, fluid can flow therethrough.

Shear pins 650 are secured between the wall and sleeve 622 to hold the sleeve in the port closed position during run in. A plug, such as ball 624, is used to create a force through sleeve 622 to shear pins, shown sheared as 650', and to move the sleeve to the port-exposed position. Ball 624 is deformable and resilient. Thus, while ball 624 has an outer diameter greater than the inner diameter across the restriction of sleeve 622, pressure acting against ball 624 can cause it to be forced through the sleeve (FIG. 8B). As ball 624 squeezes through the sleeve, it creates a force on the sleeve. This force is used to manipulate the actuator and, in this embodiment, to shift sleeve 622 to the port-exposed position. Ball 624 is resilient, however, such that after it passes through sleeve 622, it then returns substantially to its original diameter (FIG. 8C).

The downhole side 622*b* of restriction IDs of sleeve 622 includes a non-circular surface such that ball 624 cannot form a seal against the sleeve and fluid can continue to pass through. Thus, although ball 624 returns substantially to its original diameter after passing down through the restriction of sleeve 622, and, therefore, is unable to pass up through the restriction the ball doesn't block production flow. The non-circular surface is formed by notches 680 that create discontinuities about the circumference of downhole side 622*b* of the sleeve's restriction. Even if ball 624 is pushed by fluid pressure against the downhole side, notches 680 provide a bypass opening for fluid flow past the ball and upwardly through the sleeve.

Figure 8A:
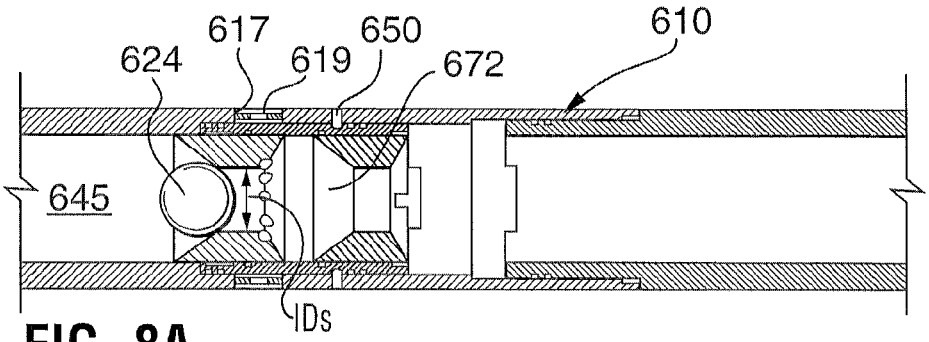
FIGS. 8A to 8C are sectional views through a wellbore apparatus according to another aspect of the present invention, the series of views show a method according to an aspect of the invention.
Figure 8B:
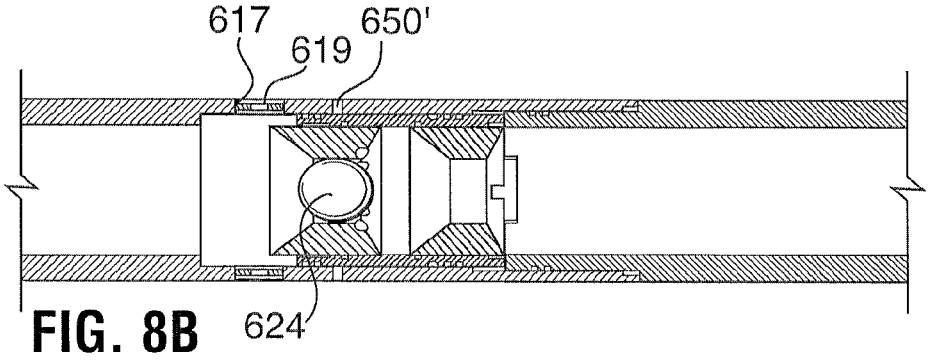
Figure 8C:
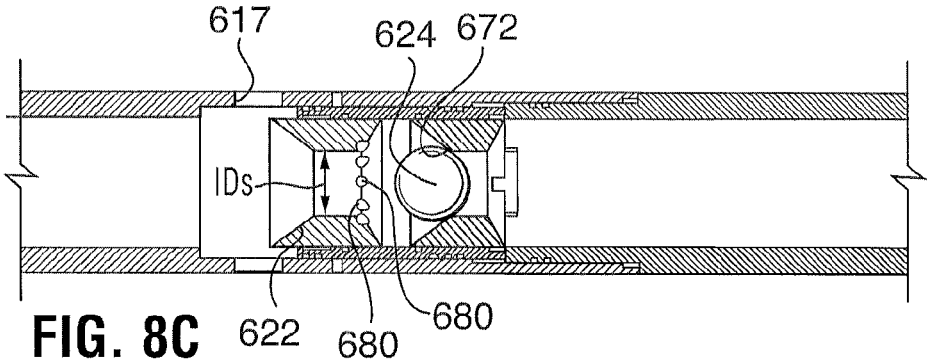

It is noted that the actuator illustrated in FIGS. 8A to 8C also includes a seat 672 capable of stopping ball 624 against further movement downhole and provides a surface against which a maintainable pressure can be developed in the string, for example, to burst insert 619 and divert fluid out through port 617 to treat the well. In such an embodiment, when pressure is dissipated ball is trapped between restriction IDs and seat 672.

Of course, the ball catcher function of notches 680 could be employed in an actuator with or without the seat 672.

Ball catchers ensure that the ball cannot move up to seat and seal against the underside of the actuator's ID restriction. Other forms of ball catchers could be provided such as fingers positioned downhole of the actuator restriction that are moved to protrude inwardly after the ball passes through the ID restriction. For example, fingers, such as straps, collet fingers, etc. that are pushed inwardly as a result of the mechanical shift caused by a ball passing through the actuator or landing on a ball seat. If a ball catcher prevents balls from moving both uphole and downhole therepast, it is selected to set only after the step where balls are to be pumped downwardly therepast.

EXAMPLE

Example 1

A wellbore assembly was used including five actuators according to FIG. 1A and a landing sub according to FIG. 8A. Each actuator included a sleeve capable of being sheared out at 500 psi (3.45 Mpa) and moved to expose a port fitted with a burst plug insert to fail at 3000 psi. The landing sub also included a sleeve capable of being sheared out at 500 psi covering a port fitted with a nozzle and a burst plug insert to fail at 3000 psi. The landing sub also included a ball seat attached at a downhole end of the sleeve having an inner diameter less than the five actuators.

For use to actuate the actuators and landing sub, a ball was selected formed of an inner core of aluminum and a coating of fluoropolymer (Xylan 1620). The coating was selected to increase the core's acid and abrasion resistance and was applied at a thickness of about 0.001". The ball had an outer diameter of 2 inches. The restrictions through the actuator sleeves and the sleeve of the landing sub each had an inner diameter selected to create a 0.015 interference fit between the ball's OD and the sleeve ID. It was determined that a pressure of approximately 1200 to 1500 psi was required to force the ball through the sleeve. The ball seat had a diameter through which the ball could not pass up to pressures of 3000 psi.

The ball was pumped through the string at a flow rate of 1.5 $m^3$/min. All sleeves were shifted to expose the ports, the ball seated on the ball seat and pressures were increased to 2455 psi causing the burst discs to fail and open the ports to nozzled flow.

Both the sleeve shifting and the final seating to pressure up the string was reliable.

Flow was reversed and it was confirmed that the ball was trapped in the landing sub. The back flow rate was 100 l/min and flow back was not impeded. There was no recordable pressure drop.

Inspection of the ball showed circumferential wear rings formed by passage through the restrictions of the sleeves. An outer diameter reduction of 0.008" to 0.010" was measured at each circumferential wear ring.

Example 2

The test of example 1 was repeated with a ball formed of polyglycolic acid. All sleeves were shifted to expose the ports. An examination of the ball, which had a 0.015" interference with the sleeve showed wear rings wherein the diameter was reduced by 0.003".

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A wellbore tubing string assembly comprising:

a string including an inner bore having an inner diameter and a first tool and a second tool installed along the string with the second tool axially offset from the first tool along the string;

the first tool including: a first sleeve slideably disposed in the inner bore, the first sleeve having an inner surface, the inner surface defining a first deformable restriction diameter smaller than the inner diameter, the first deformable restriction diameter configured to receive and be actuated by passage of an elastically deformable sealing device travelling through the first deformable restriction diameter in a downhole direction and the first sleeve being reconfigurable through an inactive condition and into an active condition; an indexing mechanism coupled to the first sleeve; and a first sensor mechanism in communication with the first sleeve and responsive to an application of force applied against the first sleeve by the elastically deformable sealing device, wherein upon detection of the application of force, the first sensor permits the first sleeve to move into the inactive condition; and the second tool including; a second sleeve slideably disposed in the inner bore, the second sleeve having an inner wall surface, the inner wall surface defining a second restriction diameter smaller than the inner diameter; and a second sensor mechanism in communication with the second sleeve and responsive to a force applied against the second sleeve; and a third sliding sleeve uphole of the first sleeve, the third sliding sleeve having an inner diameter larger than the first deformable restriction diameter and the elastically deformable sealing device passes readily through the third sleeve to arrive at the first restriction diameter;

wherein the indexing mechanism and the first sensor, are configured to respond to passage of the elastically deformable sealing device travelling in the downhole direction and deforming and squeezing through the first deformable restriction diameter to create the application of force against the first sleeve to thereby move the first sleeve through the inactive condition, and wherein the second sleeve is configured for receipt and actuation by the elastically deformable sealing device after passage through the first sleeve; and wherein the indexing mechanism and the first sensor are further configured to respond to arrival of a second elastically deformable sealing device, after passage of the elastically deformable sealing device, to create another application of force against the first sleeve to thereby move the first sleeve from the inactive condition to the active condition.

2. The wellbore tubing string assembly of claim 1 wherein the elastically deformable sealing device is a ball.

3. The wellbore tubing string assembly of claim 1 wherein the elastically deformable sealing device has an interference fit with the first restriction diameter of at least 0.005".

4. The wellbore tubing string assembly of claim 1 wherein the second tool is actuated by the elastically deformable sealing device, wherein the elastically deformable sealing device elastically reforms to its original shape and size after passage through the first sleeve and the second tool is configured to receive the elastically deformable sealing device and is actuated by the elastically deformable sealing device deforming, squeezing through and thereby applying a force against the second restriction diameter.

5. The wellbore tubing string assembly of claim 1 wherein the first sleeve covers a port in the tubing string wall and wherein in the active condition, the first sleeve has moved to expose the port to the inner diameter.

6. The wellbore tubing string assembly of claim 5 wherein the port has positioned therein a flow limiting insert.

* * * * *